US007075429B2

(12) United States Patent
Marshall

(10) Patent No.: US 7,075,429 B2
(45) Date of Patent: Jul. 11, 2006

(54) ALARM WITH REMOTE MONITOR AND DELAY TIMER

(76) Inventor: Cranbrook Marshall, P.O. Box 1401, Aztec, NM (US) 87410

( * ) Notice: Subject to any disclaimer, the term of this patent is extended or adjusted under 35 U.S.C. 154(b) by 99 days.

(21) Appl. No.: 10/966,459

(22) Filed: Oct. 14, 2004

(65) Prior Publication Data

US 2006/0082456 A1 Apr. 20, 2006

(51) Int. Cl.
*G08B 21/00* (2006.01)

(52) U.S. Cl. ..... 340/540; 340/545.2; 340/545.3; 340/568.1; 340/568.2

(58) Field of Classification Search ..... 340/540, 340/545.2, 545.3, 568.1, 568.2, 458, 642
See application file for complete search history.

(56) References Cited

U.S. PATENT DOCUMENTS

| | | | | |
|---|---|---|---|---|
| 4,257,038 | A * | 3/1981 | Rounds et al. | 340/539.16 |
| 4,297,684 | A | 10/1981 | Butter | |
| 4,982,176 | A * | 1/1991 | Schwarz | 340/567 |
| 5,440,290 | A * | 8/1995 | McCullough et al. | 340/552 |
| 5,600,307 | A * | 2/1997 | Aslan | 340/600 |
| 5,821,853 | A | 10/1998 | Gustavson et al. | |
| 5,854,588 | A | 12/1998 | Dockery | |
| 6,021,269 | A | 2/2000 | Lewis | |
| 6,147,620 | A * | 11/2000 | Remmers et al. | 340/815.42 |
| 6,218,953 | B1 | 4/2001 | Petite et al. | |
| 6,305,602 | B1 * | 10/2001 | Grabowski et al. | 235/379 |
| 6,320,506 | B1 * | 11/2001 | Ferraro | 340/568.1 |
| 6,369,704 | B1 * | 4/2002 | Hilleary | 340/458 |
| 6,407,667 | B1 * | 6/2002 | Jackson et al. | 340/568.6 |
| 6,491,216 | B1 | 12/2002 | May | |
| 6,583,813 | B1 | 6/2003 | Enright et al. | |
| 6,715,673 | B1 | 4/2004 | Fulcher et al. | |
| 6,766,943 | B1 | 7/2004 | Magee et al. | |
| 2002/0190855 | A1 * | 12/2002 | Bone | 340/527 |
| 2004/0141059 | A1 | 7/2004 | Enright et al. | |

OTHER PUBLICATIONS

National Semiconductor, LM2900/LM3900 Quad Amplifiers Typical Applications: Amplifiers, Trigger, Filters, DC gain, etc.

* cited by examiner

*Primary Examiner*—Jeffery Hofsass
*Assistant Examiner*—Edny Labbees

(57) ABSTRACT

An alarm apparatus for detecting an intrusion or compromise situation upon critical equipment or private areas. The apparatus detects an unauthorized radio transmitter (like a wireless camera), or the covering of a critical piece of equipment. Fiber optics, solar cells and special radio antennas are used to detect intrusion remotely and a delay timer will allow normal activity to occur, while reducing false alarms. This alarm apparatus will notify an existing system of the intrusion or compromise when limits are exceeded. This alarm apparatus also addresses privacy concerns of wireless cameras and recording devices in areas like changing rooms, bathrooms, or boardrooms. The apparatus addresses security issues for critical devices like smoke alarms and ATM machines.

5 Claims, 7 Drawing Sheets

I-I

ALARM WITH REMOTE MONITOR AND DELAY TIMER

CROSS-REFERENCE TO RELATED APPLICATIONS (not applicable)

FEDERALLY SPONSORED RESEARCH (not applicable)

SEQUENCE LISTING (not applicable)

BACKGROUND OF THE INVENTION

1. Field of the Invention

This alarm apparatus involves alarm systems, fiber optics, basic electronics, light sensors, and radio frequency detection. The issues are protection of privacy and security of data and equipment.

2. Background of the Related Art

The privacy of the individual is being compromised by new wireless video cameras. They are being used illegally or improperly in or around private places such as changing rooms, bathrooms, motel rooms, and in public places like ATM machines and showers. Locating these have been accidental or at great cost.

U.S. Pat. No. 6,021,269 instructs that radiation transmitting devices ("Bugs") may be located by searching the area with specialized equipment. These "bugs" are a threat to the privacy of the individual and businesses. Leaky data cables may also be located as they are a security and reliability problem in communications. This method of detection is very expensive and provides for neither continued security nor guaranteed future privacy.

A radio transmitter may be located with a broadband radio. Some types of broadband radios include: radio scanner (a common device that looks at one specific frequency at a time), a spectrum analyzer (looks at many frequencies at the same time and is very expensive) and radio frequency (RF) detector ("bug detector", which also looks at many frequencies but costs much less). The original crystal (one diode) radio is a type of bug detector as it locates the strongest signal in its frequency range and converts the radio energy to audio. A person can carry around a modem bug detector and hope that the RF detector circuitry is current.

The alarm industry typically looks for an intrusion or abnormal condition. This may be accomplished with mechanical or magnetic switches. Alarms may also monitor interruption or interference with some form of energy such as, light, microwave, and sound. U.S. Pat. No. 5,854,588 incorporates a delay timer, which will allow the property owner time to exit or enter. These commercial alarm systems normally do not defend against a specific device being installed such as a radio transmitter ("wireless bug"). They do not protect critical devices (such as a smoke detector, emergency switch or card reader) from being modified, covered, or compromised.

Reliable lighting will provide security, especially in areas around ATMs. General area lighting is important for operation of an ATM machine and for the users feeling of safety. U.S. Pat. No. 5,821,853 describes an alarm system for monitoring the ambient lights in a general area, using a timer circuit and opto-isolated output for alarming if the average lighting drops below a predetermined level. This will comply with codes that require ambient lighting to be at a certain level, but does not monitor specific equipment.

U.S. Pat. Nos. 6,218,953, and 6,305,602 places light monitors in different non-specific locations and utilizes a controller or computer to monitor for a reduction of ambient lighting. The ATM may be shut down from lighting problems, which alerts the criminal to protection and causes any illegal activity to move to less protected equipment. If a fake fascia is placed over the authorized machine, there is no alarm to alert the security of possible breach with those ambient light monitors that are not installed on the front of the ATM machine.

One of the reasons that ATM ambient lighting became important was due to safety and security of the ATM user. The criminal technique of watching the ATM user and noting the PIN number, is known as skimming. When the criminal sees the PIN, they physically grab the card and run to another machine and start to withdraw money. The increase in lighting reliability tries to address that problem. However, with newer technology the criminal can wait in the car and collect all the information needed, email the information across the country and the customer does not even realize the bank account has been compromised. This is done with an unauthorized card swipe (fraud) device and a video camera illegally installed at the ATM machine.

U.S. Pat. Nos. 6,766,943 and 6,491,216 provides security against some fraud devices by monitoring light inside the card reader slot. 943 informs us that criminals are ingenious and have produced reading devices that can interpret credit card data and may be able to conduct unauthorized transactions with the consumer card number. Such external reading or recording devices may be made to appear to be a part of the normal ATM fascia. The 943 solution is to illuminate the card reader slot with radio, light, and/or vibration and have the computer sense if a fraud device has been attached. Preventing this criminal technique is known as "anti-skimming", however it will not detect the unauthorized card reader or wireless camera located a short distance away.

U.S. Pat. No. 6,715,673 shows how a device other than an ATM can take money or a credit card and dispense something of value, like a parking lot ticket. This type of apparatus could benefit from anti-skimming protection as this invention could provide.

Any equipment that takes a credit or debit card can be "skimmed". Examples include a gas pump, or theater ticket dispenser. Existing locations would require major re-work and/or module or controller replacement to protect such equipment from skimming. A simple solution would be very desirable.

U.S. Pat. No. 6,583,813 describes the security and skimming problems and presents solutions with multiple video cameras, complex systems, and a need for network with large bandwidth for communications. This will only work for the newer ATM machines with good communications, but will not support older ATM machines.

The solutions considered for security of ATM operations involve adding complex new features into the card reader slot and increasing the controller programming. Proposed designs include generating oscillation, vibration, and jitter at the card reader slot, then monitoring to see if it has changed. Also to set up infrared and visible light generation at the card reader slot with sensors to see if something unauthorized has been added. These are very complex methods to protect the ATM machine and require factory installation, alignment, and new computer programming. The suggested methods would be difficult to incorporate in the older machines. Any monitor at the card reader slot will not detect the unauthorized wireless camera or recording device that has been placed at a location away from the card reader.

Another solution that banking industry has considered is to publish a warning for the public to remain aware of anything unusual about the ATM machine and not to use it if it looks fishy. There are many new styles of machines being produced daily that look different from the older machines and could "look fishy". This suggestion could be confusing to the average ATM user.

Fiber optic technology is common in telecommunications for data transfer and in entertainment for light illumination. U.S. Pat. No. 4,297,684 uses a fiber optic cable in an intrusion alarm system and uses the fiber as a transmitter of light.

Solar cell technology has been improving in efficiency and reliability for many years. One improvement has been in the field of flexibility. Ambient light may be monitored by concealing a small quantity of flexible light sensing material, such as solar cell material, inside or behind a sticker or label. Using fiber optics to monitor ambient light is not common and therefore the application is unique. Using a light detection material like a solar cell to monitor ambient light is not common and therefore the application is unique. This could provide security for critical equipment that should remain in service.

BRIEF SUMMARY OF THE INVENTION

It is an object of the present invention to provide an alarm apparatus.

It is a further object of the present invention to provide an alarm apparatus that is reliable, flexible, and easy to install and maintain.

It is a further object of the present invention to provide an alarm apparatus that protects the privacy of the public.

It is a further object of the present invention to protect an area or equipment from illegal or immoral use of wireless cameras or recording (fraud) devices. Issues of privacy and security have been discussed for many years but intrusion and compromise are more common than the solutions.

The three features of this invention includes; 1) the remote monitoring for the absence of ambient light through the use of a light detector, 2) remote monitoring for the absence of ambient light through the use of fiber optics, and 3) remote monitoring for an unauthorized radio transmitter. These three features are each supported by a delay timer, the combination of which is unique and will allow normal activity to occur. Exceeding time limits will activate an alarm system to alert security personnel when pre-set limits are exceeded.

The use of solar material has been in use for many years as a source of energy gathering and battery charging, but is not common for light detection. The thinner material will allow ease of attachment onto an existing surface without affecting the operation. The light detecting material may be a solar cell or photo-resistor. The amount of solar cell material needed is very small because no current is required. The solar cell or other light sensitive material may be disguised as a sticker or label.

Another unique feature of this invention is the combination of the fiber optic cable with a light detector such as a photo-transistor, and a delay timer. This combination will allow normal activity to occur so that an alarm will be tripped if critical equipment is covered or concealed for a period of time. Use of the fiber optic material has been in common use to transmit light for data and for entertainment, but seldom for monitoring purposes.

When the fiber is installed at an angle it will detect a major portion of light in the direction of the hole and not perpendicular to the surface. This is unexpected and will allow the detection of light to be very specific in coverage without interfering with the operation of the equipment protected.

The alarm apparatus may be installed in a secure location using the fiber optic cable to monitor and protect the critical equipment remotely. The end of the fiber is installed into a very small Oust-fit) hole with only the end (cut flush) showing. A fiber optic installation (about ½ millimeter) is about the size of the dot on the letter "i". The fiber is easy to install and difficult to detect.

An ATM may have a fiber optic cable installed below a card reader at an angle which will alarm if even a piece of paper is placed over the card reader. A vibration or oscillation detection device installed at the card reader slot will not detect that type of cover. This fiber optic cable installation will not interfere with the operation of the card reader.

Light monitoring with the fiber optics and the light sensor techniques does not infringe upon security or privacy. The present invention will protect the equipment and persons from illegal or immoral wireless and digital monitoring.

The present invention may use a broadband radio detection method, which can range from a diode (crystal) radio principle to a commercial bug detector. The desired area coverage and transmitter detection needed will determine the level of design requirement. The bug detector is not within the scope of this invention.

A unique feature of this invention is the combination of a remote antenna with a (broadband) radio detector and a delay timer. The radio detection circuit will monitor a remote area and allow normal radio activity to occur. A radio transmitter (unauthorized device) that is left turned on close to the remote area (common in wireless video camera and data equipment) will trip the alarm. The range of the radio detection is dependent upon the quality of the radio detector, type of coax, design of the antenna, and the power of the unauthorized device.

The remote antenna will allow installation of the alarm apparatus in a secure location, while monitoring for the radio intrusion at a remote location. The antenna design may be a commercial (scanner type) antenna or a field assembled design. Some suggestions are in the detailed description. The antenna is installed behind non-conductive (plastic or wood) material to allow radio detection while not being obvious.

Radio detection with the remote antenna and delay timer technique does not infringe upon security or privacy. The present invention will protect the equipment and persons from illegal (or immoral) wireless and digital monitoring.

The methods and circuits are common and will be obvious to one skilled in the art, however the combination of a remote monitoring feature and a delay timer is unique and will offer protection of privacy and solutions to security problems.

BRIEF DESCRIPTION OF THE DRAWINGS

These and other more detailed and specific objects and features of the present invention are more fully disclosed in the following specification, reference being had to the accompanying drawings, in which.

DETAILED DESCRIPTION OF THE INVENTION

Figure 1:
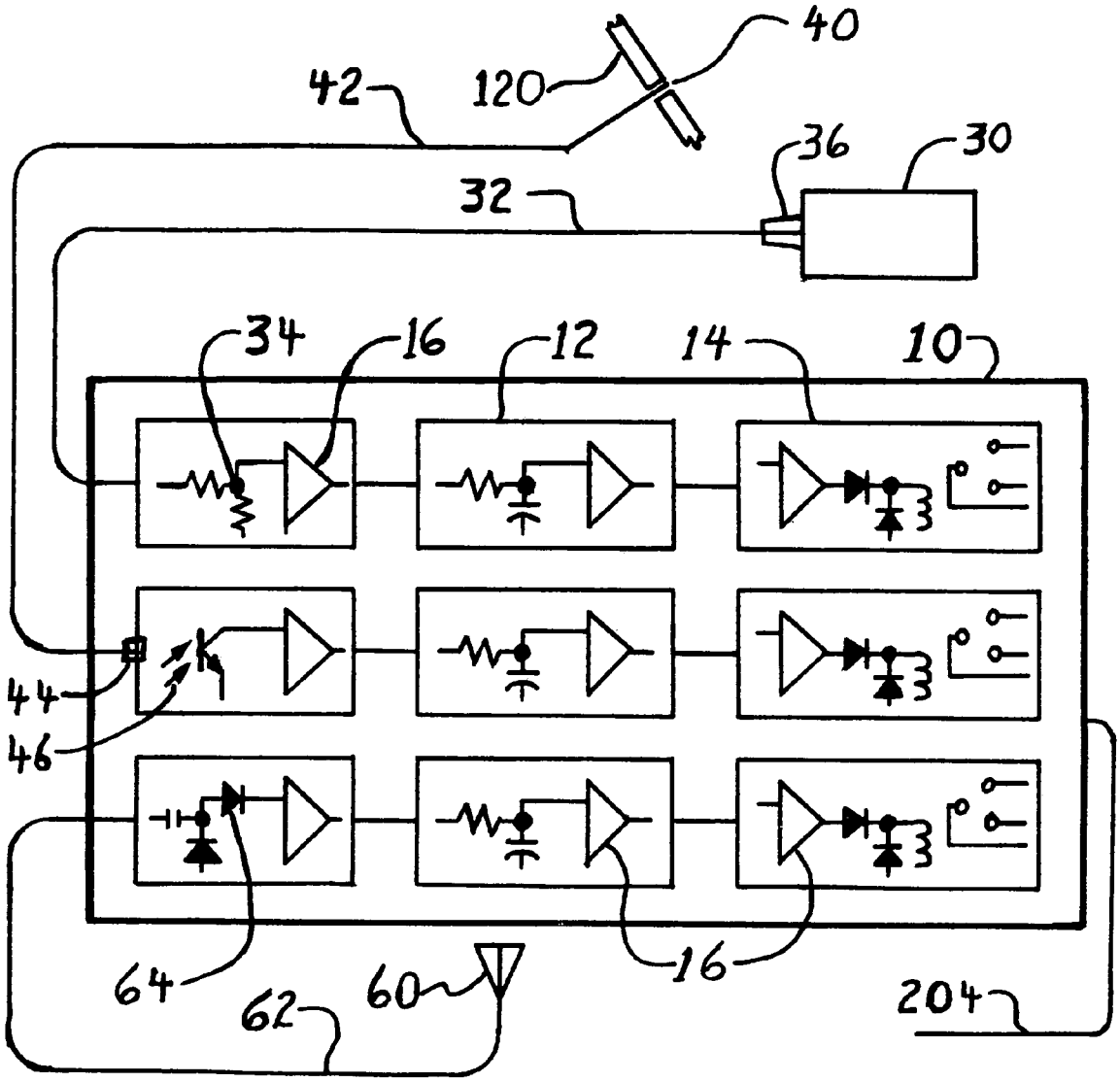
FIG. 1 shows the general schematic with the basic components.

FIG. 1 shows a schematic of the alarm apparatus 10. The three features (remote monitors) of this invention are: a light detector using a Fiber optic cable 42, a light sensor 30, and radio detector 64 with a remote antenna 60. Each uses a delay timer 12.

In a preferred embodiment, the alarm apparatus 10 will contain one or more of the three features. An application may have multiple cases of any one feature. Each feature will have a remote monitor and a delay timer 12, which will drive an isolated alarm output 14.

In a preferred embodiment, the alarm apparatus 10 monitors ambient light at a remote location and trips the alarm output 14 if the ambient light level drops to a pre determined value for a predetermined length of time. In one embodiment a light sensor 30 monitors the ambient light sending the signal through wiring 32 and/or 36 to the voltage divider 34. The light sensor 30 may be thin and flexible and may be a surface mounted photo-resistor or a solar cell In a preferred embodiment, the alarm apparatus 10 monitors ambient light from the fiber optic installation 40 through the fiber optic cable 42 to a sensor, such as the phototransistor 46 at the fiber optic assembly 44.

In a preferred embodiment, the alarm apparatus 10 monitors remote radio activity at an antenna 60 through a coaxial cable 62 to the radio frequency detector 64. The alarm apparatus 10 trips the alarm output relay 14 when radio activity exceeds a predetermined level for a predetermined length of time, set by the delay timer 12.

In a preferred embodiment, the alarm apparatus 10 assembly is constructed in a container or box to provide easy installation.

In an alternate embodiment, the alarm apparatus 10 assembly is constructed onto a card, which may be inserted into an existing rack. This will provide a compatible interface to existing equipment.

The following paragraphs describe the techniques to manufacture this invention.

In FIG. 1, the operational amplifier (op amp) 16 may be used as a driver, buffer or as a delay timer. An alarm apparatus 10 construction could use almost any op amp 16 such as an LM2900 Quad op amp. The specific circuitry may be found in the specification sheets and will be obvious to one skilled in the art.

The delay timer 12 may consist of timing circuitry with a capacitor. This will allow normal activity to occur for 1 to 10 minutes or 5 to 50 minutes before tripping the alarm. The setting will be determined by the needs of the situation. The isolated output 14 may be a relay or an opto-isolated device.

Figure 2:
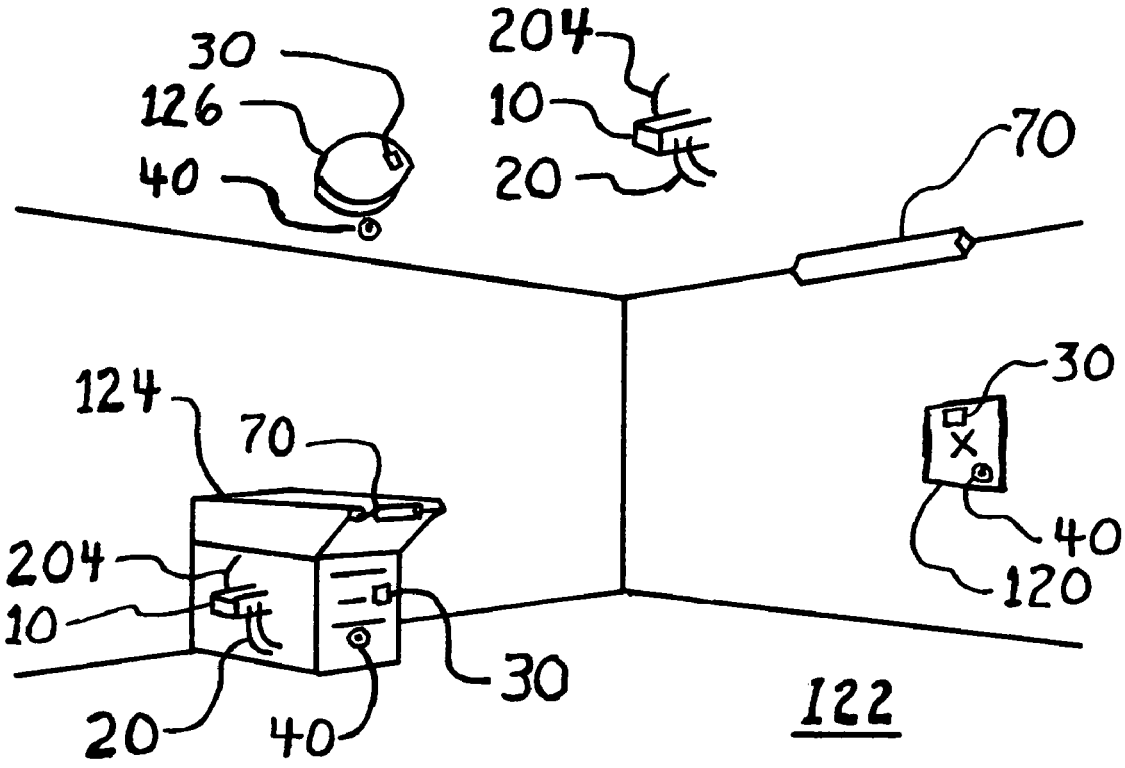
FIG. 2 shows a room with two applications.

FIG. 2 shows a room 122 with two applications of the alarm apparatus 10. The wiring from existing alarm and/or control systems use wiring harness 204 to the alarm apparatus 10 and are not within the scope of this invention. The combined wiring 20 includes cables 32, 42, and/or 62 from the remote monitors.

In FIG. 2, the equipment container 124 has one alarm apparatus 10, which monitors one radio trim/antenna 70 (which contains antenna 60 per FIG. 10), one fiber optic installation 40 and one light sensor 30.

In FIG. 2, the ceiling has one alarm apparatus 10 supporting a smoke detector 126 and a protected critical device 120 on the wall. Both smoke detector 126 and critical device 120 has a light sensor 30 and a fiber optic installation 40. The room 122 has a radio trim/antenna 70, which contains antenna 60 per FIG. 10. The ceiling alarm apparatus 10 may be attached to the ceiling, above the ceiling, or in a remote secure location.

Figure 3:
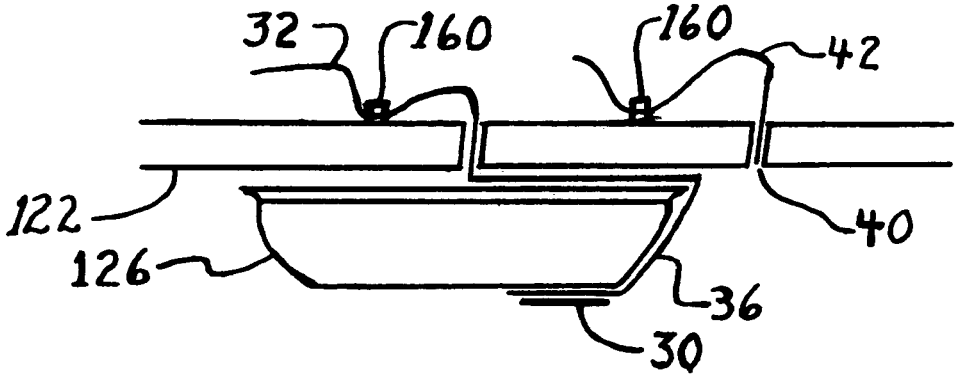
FIG. 3 shows details of a protected smoke detector.

In a preferred embodiment, FIG. 3 shows the details of a smoke detector 126 protected by a fiber optic installation 40 and a light sensor 30. A strain relief 160 holds the wiring 32 and the fiber optic cable 42.

Figure 4:
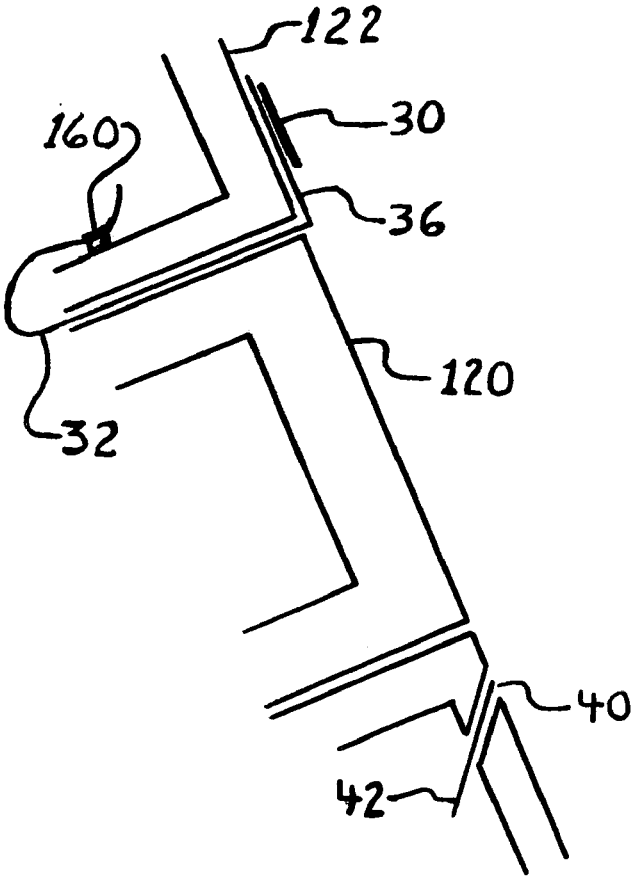
FIG. 4 shows details of non-contact equipment protection.

In a preferred embodiment, FIG. 4 shows a critical device 120 mounted on a wall 122. The remote monitors (light sensor 30 and fiber optic installation 40) are not attached to, but are protecting the critical device 120, which is similar to card reader 120 protection in FIG. 6, FIG. 14 and FIG. 15.

Figure 5:
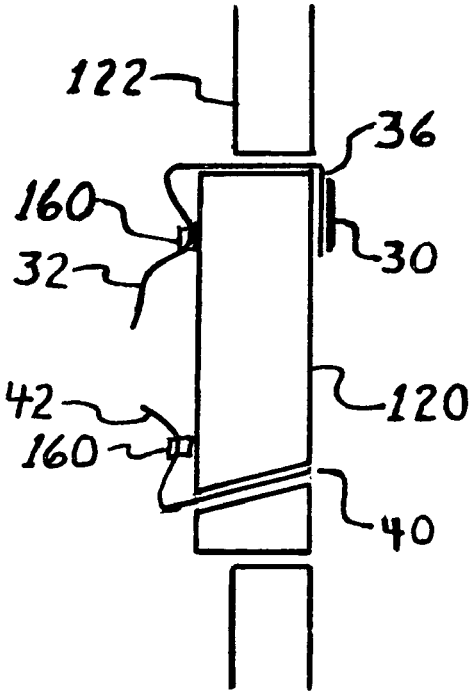
FIG. 5 shows details of a critical equipment protection.

FIG. 5 shows the details of remote monitors for light, similar to the room 122 wall critical device 120 in FIG. 2. FIG. 5 shows the light sensor 30 and fiber optic installation 40 on the same critical device 120 that is being protected. The light sensor 30 may be a flexible material and has a means of attachment to a surface. A flexible strip 36 carries the signal from the light sensor 30 to the wiring 32. The use of the flexible strip 36 is optional and would allow unobtrusive installation without interfering with operation. A strain relief 160 holds the wiring 32 and fiber optic cable 42 to the equipment. An example of this critical device 120 is an emergency shutdown switch.

Figure 12:
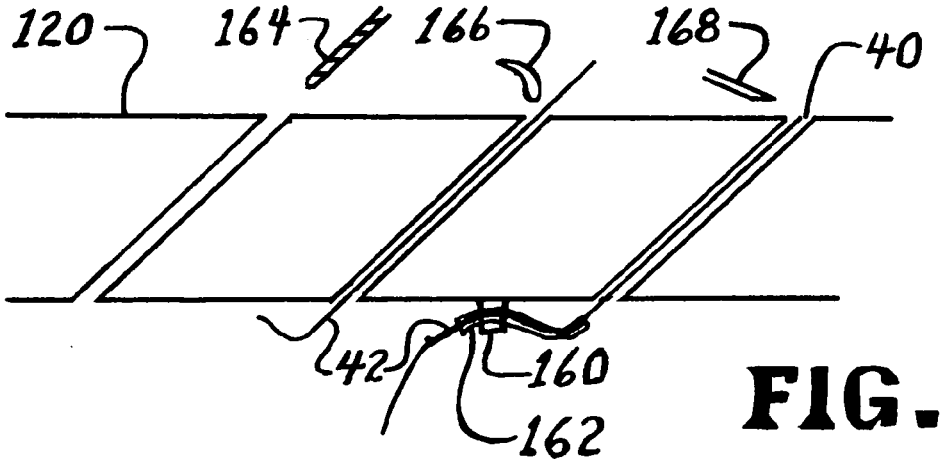
FIG. 12 shows details of a fiber optic installation method.

The fiber optic installation 40 offers a solution, which is not obvious, that the area protected is not necessarily directly over (or perpendicular to) the surface of the fiber optic installation 40. The light in the direction of the hole will be monitored and only a small percentage of perpendicular (to the surface) light will be monitored. Trimming the fiber optic cable 42 at an angle only slightly affects the direction of light. In FIG. 12, the fiber is installed at an angle pointing across or in front of the critical device 120 being protected (card reader, video camera, emergency switch, or smoke detector) at a source of ambient light. This feature will allow protection of the critical device 120 while not attached to, or interfering with, operation of said critical device 120.

Figure 11:
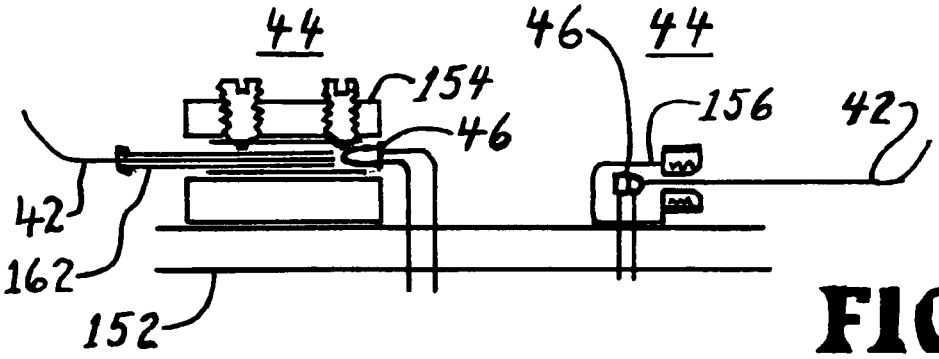
FIG. 11 shows details of two fiber optic assemblies

In FIG. 11 The preferred embodiment for fiber optic assembly 44 uses a holding method such as a commercial holder 156. The holder 156 provides a means for holding the fiber 42 (core) in the correct position and includes the photo-transistor 46, which is attached to the circuit board 152.

An alternate embodiment of the fiber optic assembly 44 may be assembled in the field. In FIG. 11, the fiber optic cable 42 is terminated at the photo-transistor 46 by a support brace around the core similar to commercial core holder. In the example, shrink fit tubing 162 may be placed over the fiber optic cable 42 (core), such that the fiber end is polished or cut flat. The fiber optic cable 42 flat (core) end is held in proximity to, and pointing directly at the light-sensing device (photo-transistor 46). An electrical screw binding post can be used for a holding device 154 and the phototransistor 46 is soldered to the circuit board 152.

In FIG. 12 the fiber optic installation 40 is shown in three steps: the hole is drilled at a diameter (drill 164) sized so that the fiber optic cable 42 (core) will just fit and will point to a source of reliable ambient lighting and across the protected critical device. The fiber optic cable 42 (core) is placed into the hole and a small quantity of a bonding material like glue 166 will hold the core in place. When the glue 166 is dried, the core end is cut flush with the surface of the protected critical device 120 with a very sharp tool such as a razor blade 168. The fiber optic cable 42 is supported by shrink fit tubing 162 (if bare core) and a strain relief 160. Fiber optic cable 42 material is available with bare core and with single, or multiple coating (sheath) for protection.

The preferred embodiment of the fiber optic cable 42 material is plastic core and there are several diameters available. The plastic fiber optic cable 42 may be small diameter (0.5 mm or smaller, which is less detectable in mounting but more difficult to work with in the field) or larger diameter (example, 0.6 mm or larger). The larger fiber is easier to work, route, and tie down. This type of fiber is common in commercial and entertainment applications, like flower lighting displays and audio equipment.

There are several types of fiber optic cable 42 core available, however the use of communications (glass core) fiber is not recommended as it is much smaller to work with (example 0.125 mm), the glass is a hazardous material, and special equipment is needed to make the ends suitable for light gathering.

The length of the fiber optic cable 42 may vary from less than a meter to many meters and the routing should be away from a bright light source if the core is bare (don't run next to a light bulb). Fiber optic cable 42 may be run along with power lines or any wiring without any interference either way. Manufactures specifications will have recommendations for the desired radius around corners and how to make bends and flex points for hinges.

Figure 13:
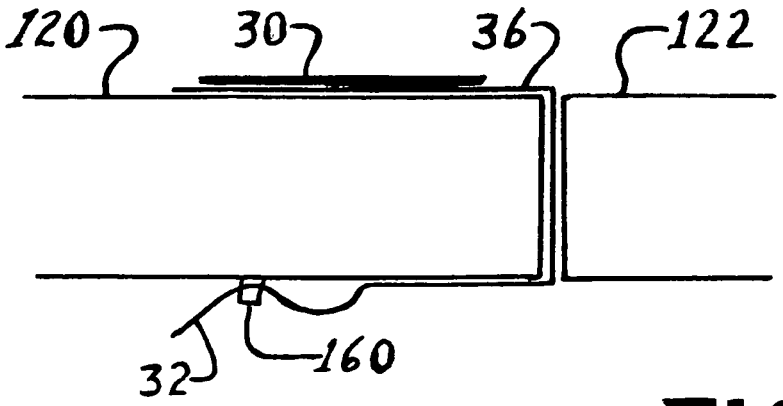
FIG. 13 shows details of a light sensor installation.

In FIG. 13 the preferred method of light sensor 30 installation is by adhesive backing and a surface coating such that the light sensor 30 blends and/or bends with the surface. The new flexible solar cells and other photo-sensing materials are very thin and will bend easily. The installation may be placed near to a mounting grove or edge and the connecting flexible strip 36 with adhesive backing, may be run over the edge. The flexible strip 36 is optional and will be tied to the regular wiring 32, which is supported by a strain relief 160. The light sensor 30 may be covered by a translucent label or sign, which conceals the nature of the light detecting material.

The use of fiber optic installation 40 or the light sensor 30 does not encroach on security or privacy issues while the use of this invention can protect critical equipment, which needs to remain in service.

FIG. 1 shows a radio frequency detector (diode detector) 64 for sensing radio frequency transmitters. Detection methods of Radio Frequency (RF) energy can range from a diode and capacitor to the more complex circuitry from off-the-shelf devices. A situation could require a band (like cellular) to be blocked if the alarm apparatus 10 is located close to a cellular tower or at a high radio usage location. In this case, a commercial bug detector or radio detector with band-pass and/or band-block circuitry could be used. Some circuitry suggestions may be found in the specification sheets for the components used. Some wireless cameras use 1.2 Ghz or 2.4 Ghz frequencies and future frequencies may be higher such as 5.8 Ghz.

Figure 7:
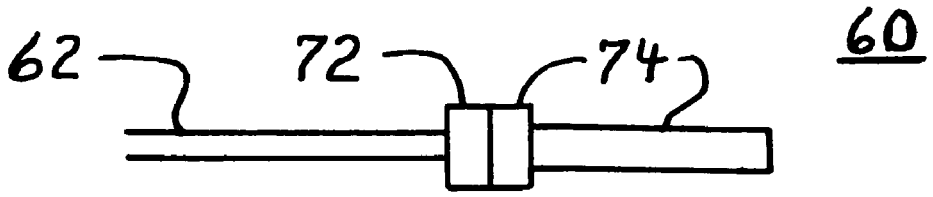
FIG. 7 shows a scanner antenna.

In a preferred embodiment, the antenna 60 will be a broadband type. In the example shown in FIG. 7, the antenna 60 may be a commercial scanner antenna with a BNC connector 74. In this example, the coax 62 will be terminated in a BNC female connector 72.

There are many types of coax 62. The common (and economical) types like CATV and audio/video cable will work well for shorter distances. A common coax RG58/U will work for most locations. Other small diameter types of coax 62 like RG174/U and M17/128-RG400 may be considered. The primary deciding factors in antenna 60 and coax 62 design are the broadband signal reception desired and the coax cable 62 signal loss per foot.

Figure 8:
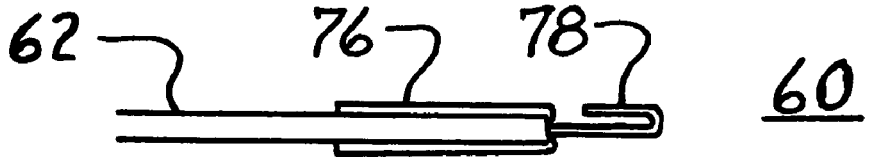
FIG. 8 shows an antenna field construction.

In FIG. 8 the field construction of an antenna 60 can be accomplished by stripping back 3 to 7 centimeters of the shield 76, revealing the center conductor 78, then covering the shield 76 with a ground plane like metal foil tape. The dimensions will vary with frequency bands desired and the type of coax 62. The center conductor 78 may have coils or bends depending upon frequency band desired.

Figure 9:
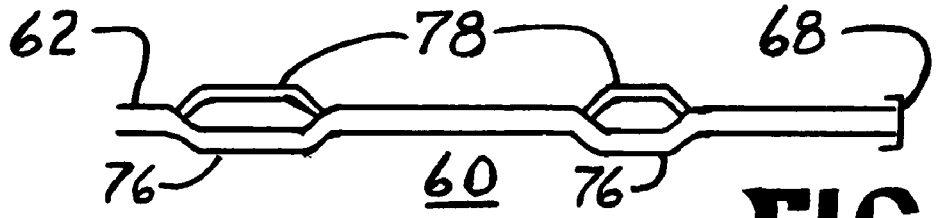
FIG. 9 shows a leaky coaxial cable detail.

In FIG. 9, a larger area of radio detection may be accomplished by converting the coax 62 into a 'leaky coax' antenna 60 by separating or splitting the shield 76 and pulling out the center conductor 78 for about 3 centimeters every 0.3 to 0.9 meters. Separating the shield 76 in this manner allows some of the RF energy to enter at intervals, which spreads out the area covered. The end of the antenna 60 will need to have a termination 68 and be insulated. This is similar to the leaky cable design used in mines and elevator shafts for radio relay and repeater operation In a preferred embodiment, FIG. 2 shows the trim/antenna 70 assembly should be placed as high as possible in the overhead, ceiling or top of equipment, such as the container 124 (or ATM 100), so as to detect and report on radio transmitting devices in the area In FIG. 8, the antenna 60 would have short range (for a small location) and an antenna 60 designed as in FIG. 9 would have greater area coverage. Coax 62 routing should be done in a manner compatible with the manufacturers standards.

Figure 10:
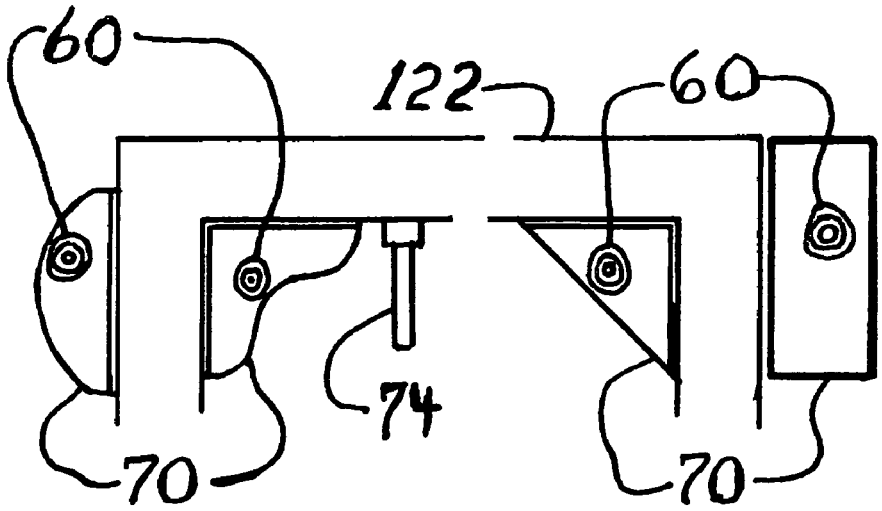
FIG. 10 shows antenna and trim ideas.

In a preferred embodiment, the antenna 60 would be mounted behind or inside a non-conducting surface (like wood or plastic), such that the radiation (RF) energy will be allowed to be monitored. In FIG. 10, the antenna 60, is inside the trim/antenna 70 and should be a distance away from the metal frame of an enclosure or metal walls of an equipment, such as the equipment container 124. A wood frame room 122 would be the easiest installation and the metal box would be the most challenging with special trim/antenna 70 or additional non-conducting fascia cover. The antenna 60 should not be placed next to a fluorescent light fixture or other RF radiating devices. In some cases a metal trim could be replaced with similar looking non-conducting trim/antenna 70. FIG. 10 shows several trim/antenna 70 side views, each with an antenna 60 inside, and one commercial antenna 74.

Figure 6:
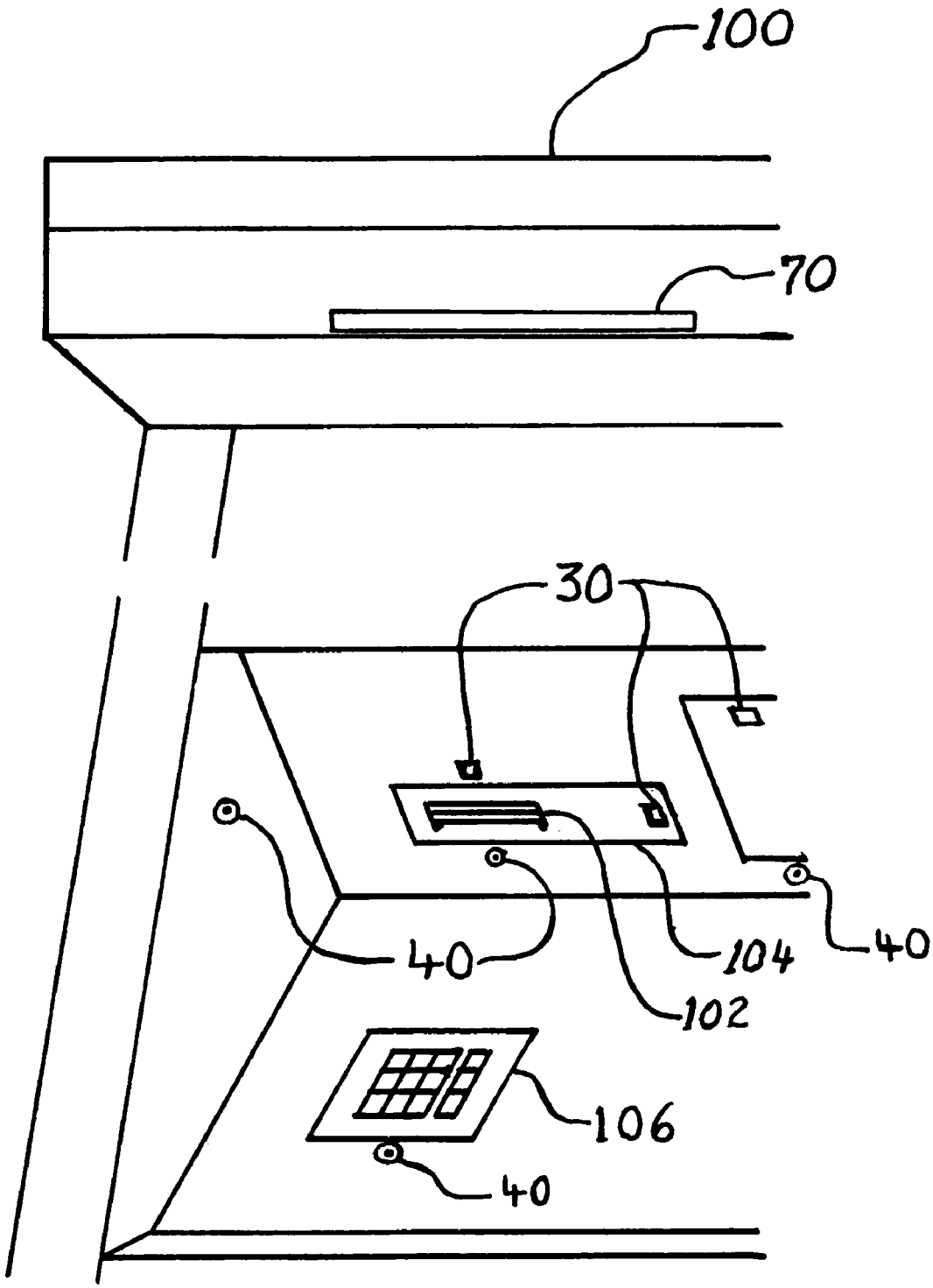
FIG. 6 shows some ATM protection ideas.

In a preferred embodiment, FIG. 6 shows a typical ATM 100 installation, which will have a plurality of fiber optic installations 40, a plurality of light sensors 30, and at least one radio detection trim/antenna 70. The card reader 104 may be protected without attaching this alarm apparatus 10 or the remote monitors to the card reader 104 as detailed in FIG. 14, and FIG. 15. The card reader 104 protection is also similar to the FIG. 4 critical device 120 installation. Other equipment on an ATM may be protected such as the keypad

106, camera, deposit slot, and the display screen. This invention provides an easy addition for older machines as well as a method to protect other areas or critical devices 120 from intrusion or compromise.

Figure 14:
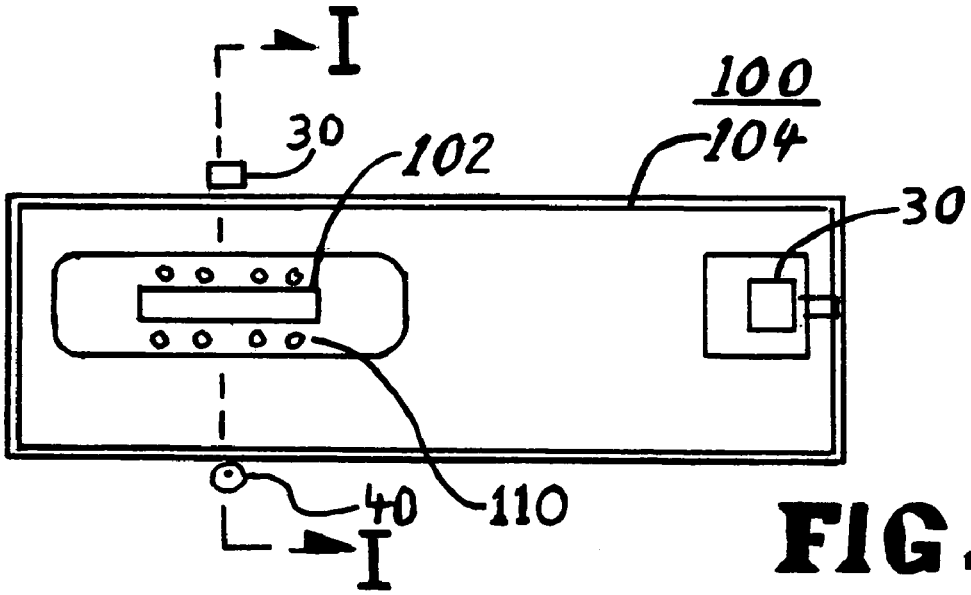
FIG. 14 shows protected ATM card reader details
Figure 15:
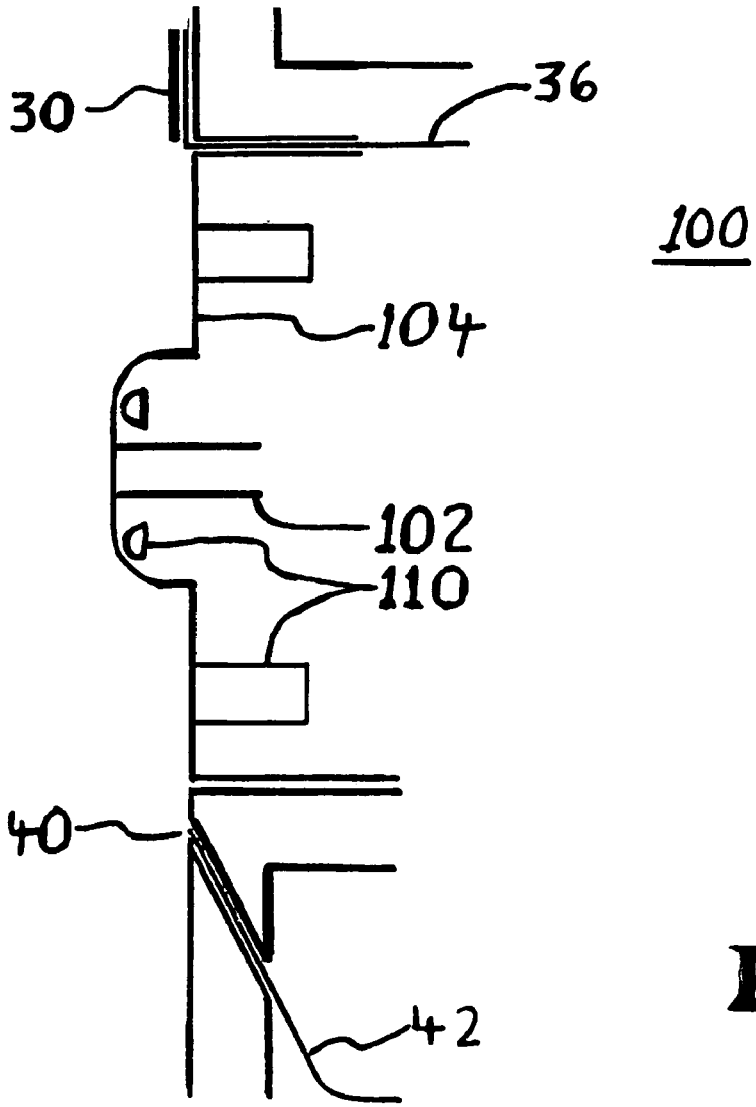
FIG. 15 shows the side view I—I of protected ATM card reader.

FIG. 14 shows an example of an ATM 100 with card reader 104 and a manufacturers protection 110 at the card reader slot 102. A preferred embodiment of this invention is the fiber optic installation 40 below the card reader 104. FIG. 15 is a side view I—I of the card reader 104. An alternate embodiment of the invention has the light sensor 30 above and/or to the side of the card reader. Some fraud devices are also installed at those locations.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the present invention.

I claim:

1. An alarm apparatus including: at least one light detector with a delay timer and at least one radio frequency detector with a delay timer, wherein the detectors provide the protection of privacy and security of data and equipment.

2. The apparatus according to claim 1 wherein said light detector uses a fiber optic cable to monitor light.

3. The apparatus according to claim 1 wherein said light detector uses a photo-sensitive material to monitor light.

4. The apparatus according to claim 3 wherein said photo-sensitive material is a solar cell.

5. The apparatus according to claim 1 wherein said radio frequency detector uses a coax cable and antenna to monitor radio frequency activity.

* * * * *